US005855217A

United States Patent [19]

John

[11] Patent Number: 5,855,217

[45] Date of Patent: Jan. 5, 1999

[54] PROCESS AND DEVICE FOR CLEANING SURFACES WHICH ARE HEAVILY SOILED WITH GREASE, STARCH AND/OR PROTEINS, ESPECIALLY IN THE FOOD PROCESSING INDUSTRY

[75] Inventor: Andreas John, Kirchheimbolanden, Germany

[73] Assignee: Diversey Lever, Inc., Plymouth, Mich.

[21] Appl. No.: 957,668

[22] Filed: Oct. 24, 1997

[30] Foreign Application Priority Data

Oct. 26, 1996 [DE] Germany ..... 196 44 653.8

[51] Int. Cl.[6] ..... B08B 3/00; B08B 5/00; B08B 9/00; C23G 5/00

[52] U.S. Cl. ..... 134/50; 134/102.1; 134/102.2; 134/100.1; 134/95.1; 134/133; 134/175; 134/198; 134/2; 134/3; 134/40; 134/29; 134/28; 134/36

[58] Field of Search ..... 134/2, 3, 40, 29, 134/28, 36, 50, 102.1, 102.2, 100.1, 95.1, 133, 198, 175

[56] References Cited

U.S. PATENT DOCUMENTS 3,760,986 9/1973 Castner et al. ..... 222/137

FOREIGN PATENT DOCUMENTS 195 04 556 8/1996 Germany .
59-024799 2/1984 Japan .
95/16023 6/1995 WIPO .
97/31087 8/1997 WIPO .

OTHER PUBLICATIONS

International Search Report dated Oct. 22, 1997.

*Primary Examiner*—Zeinab El-Arini
*Attorney, Agent, or Firm*—A. Kate Huffman

[57] ABSTRACT

A device for cleaning surfaces which are soiled in the food industry with grease, starch or protein residues including: a housing body having a first inlet for feeding pressurized water; a propulsion jet positioned behind the inlet and in a direction of flow; a collection jet positioned behind the propulsion jet which is flow connected with a second inlet for feeding a chlorine-free alkaline foam cleaning agent and a third inlet for feeding a hydrogen peroxide solution; and a turbulence chamber into which an elongated jet body of the collection jet extends, the turbulence chamber fitted with a chamber inlet for feeding compressed air into the chamber such that a hydrogen peroxide foam is formed from a solution formed upon dosing an effective amount of the hydrogen peroxide solution into the chlorine-free alkaline foam cleaner at a maximum of 60 seconds prior to contact of the hydrogen peroxide foam with a surface to be cleaned, the turbulence chamber further having a chamber outlet through which the hydrogen peroxide foam leaves the chamber to contact the surface, the chamber inlet and the chamber outlet being fitted in a direction of flow ahead of an outlet orifice of the jet body.

8 Claims, 1 Drawing Sheet

PROCESS AND DEVICE FOR CLEANING SURFACES WHICH ARE HEAVILY SOILED WITH GREASE, STARCH AND/OR PROTEINS, ESPECIALLY IN THE FOOD PROCESSING INDUSTRY

FIELD OF THE INVENTION

The invention concerns the technical field of cleaning heavily soiled surfaces in the food processing area, for instance in the meat and fish processing industries, vegetables processing or the pastry industry. The invention particularly concerns a process according to the concept as summarised in claim 1 as well as a device for carrying out the process according to the invention.

BACKGROUND OF THE INVENTION

In the food processing industry, in particular in heavily soiled areas, such as slaughterhouses or meat and fish processing industries, tenacious soiling through grease, protein and starch residues is the rule of the day. According to a practical state of the art, for cleaning such stubborn soiling, alkaline cleaning agents containing chlorine are regularly used. Because of the chlorine content of the cleaning agent, combined with an alkaline medium, the grease, starch and protein soiling is dissociated, whereby shorter molecule components are created from molecules with a longer chain, which are then capable of being emulsified by surfactants present in the cleaning agents.

However, the high volumes of waste water created in this way cause severe problems because of their chlorine content. On the one hand, the environmental effect of waste water containing chlorine is not insignificant. On the other hand, if accidentally instead of an alkaline medium an acid medium exists or is created, gaseous chlorine may be generated, creating an occupational hazard. Therefore, the use of oxidising cleaning agents based on chlorine is generally problematic in the said industry areas.

Hence the problem is posed to provide a less ecologically harmful cleaning process, which however, as regards its cleaning properties, is at least equal to processes using cleaning agents containing chlorine, or which exceed the cleaning action of the latter at equal or even lower dosages. A further purpose of the invention is to provide an appropriate device for carrying out the process.

DEFINITION OF THE INVENTION

These problems, as well as other problems which are not presented individually, are solved by a cleaning process of the type mentioned at the beginning, characterised by the features indicated by the characterising part of claim 1. Effective process modifications are protected by the subclaims which are standing in relation to claim 1.

With regard to a particularly appropriate device for performing the process according to the invention, the subject of claim 7 provides a solution for the problems underlying the invention. Favourable embodiments are the subject of the claims which relate to claim 7.

DETAILED DESCRIPTION OF THE INVENTION

Because of the fact that an effective amount of hydrogen peroxide solution is added to the chlorine-free alkaline foam cleaner at the latest 60 seconds before contact with the surface to be treated, in order to obtain an hydrogen peroxide foam which is able to clean effectively, it is possible to substitute the alkaline foam cleaners which contain chlorine and which were being used generally up to now and which were causing environmental pollution because of their chlorine content. Because of the environmental harmlessness of a hydrogen peroxide solution, the environmental pollution is clearly reduced with a cleaning process according to the invention, in particular the substances used are a priori less harmful with respect to the environment.

Furthermore, the cleaning process according to the invention is superior compared to the process according to the practical state of the art as regards occupational safety aspects. In case of accidental contact with acids or an acid medium, no toxic gases can develop from the cleaning system according to the invention.

Finally, the cleaning process according to the invention provides further unexpected advantages as compared with the state of the art.

Thus, it can be considered particularly surprising that it was possible after all that by using a hydrogen peroxide solution a foam cleaner is produced with sufficient foam stability. Apart from this, it could also not be expected that the cleaning action, which can be obtained with the cleaning process according to the invention, is a clear improvement on the most recent state of the art. Finally, the professional could not foresee without anything else that the foam system consisting of two components possesses, apart from a cleaning activity, also a microbiological activity, which is increased unexpectedly in comparison with the use of individual components.

The alkaline foam cleaner to be used in the cleaning process according to the invention consists of at least two components, which should be mixed shortly before application.

In this respect, "shortly" means, in the sense of the invention, that one of the components, i.e., the chlorine-free alkaline foam cleaner, has to be mixed with the other component, i.e., the hydrogen peroxide solution, not later than 60 seconds before the contact with the surface to be treated. If this interval is clearly exceeded, oxidative deterioration of the cleaning components contained in the alkaline foam cleaner may develop. One should strive to mix both components as shortly as possible before application to the surfaces to be cleaned. This corresponds with a preferred modification of the process according to the invention, i.e. to add the hydrogen peroxide solution to the chlorine-free alkaline foam cleaner at the latest 10 seconds before contact with the surface to be treated.

The cleaning process according to the invention is characterised as being particularly effective when the hydrogen peroxide solution is added to the alkaline foam cleaner within a period of time in the range of 0.01 to 1 seconds before contact of the hydrogen peroxide foam, which is being released during the addition, with the surface to be treated.

Thereby, pre-mixing of both components of the foam cleaning system to be applied according to the invention may be done in any manner which is known to the professional and which is appropriate at the same time. Thus it is e.g. possible to mix the chlorine-free alkaline foam cleaner and the hydrogen peroxide solution batch-wise together and then to use them within a short period of time. Contrary to this, however, it is much more preferred to add the hydrogen peroxide solution continuously to the alkaline foam cleaner solution. In this context, both components to be kept separately until shortly before the application, for example as concentrates, may be adjusted by means of water under pressure to the application concentration. It is particularly advantageous to dose the hydrogen peroxide solution in such a quantity as is required for the consumption of the hydrogen peroxide foam which is active in the cleaning of the soiled surfaces. With respect to batch-wise mixing, this continuous process furthermore has the advantage that it is capable to practically prevent completely the premature dissociation of the $H_2O_2$ into inactive components in the alkaline cleaning solution.

In the alkaline medium, $H_2O_2$ is converted much more into the active $HO_2$ anion, which then should be considered to be the actual oxidising bleach component. In this way, because of the minimal mixing and contact times during the continuous process, the efficiency of the hydrogen peroxide foam cleaner according to the invention is clearly enhanced as compared to a batch-wise procedure.

The process according to the invention may be performed in a particularly advantageous way by using special mixing devices, which enable intensive mixing of both components of the foam cleaning system according to the invention at extremely short mixing times, while allowing the air supply which is required for producing the foam. For this purpose, for instance, special injection systems, which will be described further following hereafter, are particularly appropriate.

One of the components of the foam cleaning system according to the invention concerns a chlorine-free alkaline foam cleaner. The chlorine-free alkaline foam cleaner may be present as a pre-concentrate, which preferably is liquid and consists of (i) 3–30 wt. % alkali hydroxide (ii) 1–10 wt. % alkyl amine oxide with the general formula I $$C_mH_{2m+1}NO(C_nH_{2n+1})_x(C_nH_{2n+1})_y \quad \text{(I)}$$

whereby m is an integer from 8–18, n is 1 or 2 and x and y are integers from 0–2, and x+y=2, (iii) 2–10 wt. % usual ingredients and (iv) made up to 100 wt. % with water.

This pre-concentrate is diluted at the time of application or shortly before to a concentration of between 0.1 and 5 weight per cent, preferably 0.1–2.5 weight per cent, particularly advantageously 0.15–2 weight per cent active ingredients (i)+(ii), usually with water or aqueous media, for instance water under pressure.

An essential component of the chlorine-free alkaline foam cleaner is the component (i). Among the alkali hydroxides capable of being used are LiOH, NaOH, KOH. Of these, KOH and NaOH are preferred, and NaOH is particularly preferred. The alkali hydroxides may be used in solid form or in the form of a solution for producing the chlorine-free alkaline foam cleaner. Usually they are present in the dissolved form in the foam cleaner, or at least they are dissolved in the application solution.

Component (ii) of the chlorine-free alkaline foam cleaner is also an essential component. Alkyl amine oxides according to the general formula I are known as such and are familiar to the professional. The compounds mentioned are either commercially available or may be synthesised according to known processes.

The alkyl amine oxide according to the general formula I shows a cationic behaviour under acidic conditions (pH<3), however, under the alkaline or neutral pH values to be maintained according to the invention they behave as non-ionic surfactants.

The alkyl amine oxides mentioned show a particularly high foam stability. Among the compounds according to the general formula I, particularly suitable are those in which:

m=8–16 n=1 x=1 and y=1

Furthermore, compounds for which m=10–14 are preferred.

Component (iii) contains all usual ingredients, which are applied in conventional alkaline foam cleaners, among others also in chlorine containing foam cleaners. The usual ingredients include the builders, like alkaline substances (e.g. potassium and sodium carbonate, sodium silicate); complexing agents (e.g. sodium diphosphate, sodium triphosphate, nitric acetic acid (NTA), nitrilo trimethyl phosphonic acid, 2 phosphonobutane-1,2,4-tricarboxylic acid,1-hydroxyethane-1,1 diphosphonic acid, N-(2-hydroxyethyl) imino diacetic acid, ethylene diamino tetra acetic acid (EDTA), 1,2,3,4 cyclopentane tetracarboxylic acid, citric acid, o-carboxymethyl tartaric acid, o-carboxymethyl oxysuccinic acid); and ion exchangers (e.g. poly(acrylic acids), poly(acrylic acid coalkylalcohols), poly(acrylic acid comaleinic acid), poly (α-hydroxy acrylic acids), poly (tetramethylene-1,2 dicarboxylic acids), poly (4-methoxytetramethylene-1,2 dicarboxylic acids), sodium aluminium silicates).

Furthermore, the usual ingredients include among others bleaching substances, with the exception of chlorine-containing compounds (e.g. perborate); bleach activators (e.g. tetra acetyl glycoluril, tetra acetyl ethylene diamine (TAED), sodium-p-iso nonanoyl oxybenzene sulphonate (iso-NOBS); bleach catalysts and bleach stabilisers.

Other possible ingredients could include additives such as enzymes (e.g. serin proteases, metalloproteases, SH-proteases, carboxyproteases, amylases, lipases); so-called "soil anti-redeposition agents" (e.g. carboxy methyl cellulose derivatives (CMC), carboxy methyl starch (CMS); foam regulators (e.g. fatty acid amides, fatty acid alkanol amides, betaine, sulpho betaine, alkyl poly glycosides, alkyl benzene sulphonates, alkyl sulphonates, fatty alcohol ethoxylates and/or propoxylates); corrosion inhibitors (e.g. soluble sodium silicate); perfumes; colorants; fillers (e.g. sodium sulphate); and formulating additives (e.g. alkyl benzene sulphonates, urea, alcohols, polyglycol ethers).

With the indicated amounts of (i) to (iii), and by adding up to 100 wt. % with water, it is possible to produce a pre-concentrate of a chlorine-free alkaline foam cleaner, which can be used not only as a pre-concentrate, but also directly as an application concentrate, provided the water content exceeds 85 weight per cent.

The other component of the two component system to be used according to the invention is standard hydrogen peroxide solution. For this purpose it is particularly preferred, in order to produce the alkaline hydrogen peroxide foam, to dose 30% $H_2O_2$ solution to the chlorine-free alkaline foam cleaner, whereby the amount is selected in such a way that the application concentration with respect to the $H_2O_2$ concentration in the hydrogen peroxide cleaner is between 0.1 and 1 weight per cent. The $H_2O_2$ amount is preferably 0.2–0.6, especially preferred for the purpose is 0.3–0.5 weight per cent.

As already mentioned, both solutions are most advantageously dosed separately by means of an injector system, so that the application concentrations may be individually adjusted to the degree and type of soiling present. This measure can be realised in an extremely effective way by using a special injector system.

Therefore, the object of the invention is also a device for performing the process, enabling separate dosing of both solutions. Through the special design of the turbulence chamber and the way the compressed air is added, particularly an improved foam structure is obtained. Apart form this, surprisingly also a particularly fine and long-lasting foam was obtained.

Following hereafter, the invention is explained in more detail by means of examples and comparative examples.

The cleaning performance of a foam cleaning system according to the invention was tested on standard types of soiling, whereby it was surprisingly shown that the system according to the invention surpassed commercially available alkaline foam cleaners containing chlorine as regards dirt removal. The tested standard types of soiling consisted of:

1. Grease/flour soiling with

30% molten lard

30% wheat flour

3 % corn flour

37% distilled water 2. mashed chicken liver 3. milk paste with

60% skimmed milk powder

40% distilled water

Test procedure:

1. A clean, dry stainless steel plate, with dimensions 10×10 cm, is weighed.

2. The standard soiling is applied to the plate. Excess soiling is removed with a serrated knife.

3. After 2 hours drying at 40° C., the plate is weighed again.

4. The plate is immersed in 5% test solutions and stored during various periods of time, depending on the type of soiling:

grease/flour 60 minutes chicken liver 30 minutes milk 15 minutes

5. At the end of each test period, the plate is removed from the solution and immersed for 30 seconds in distilled water, to remove residual solution.

6. The plate is dried at 40° C. during the night and weighed again.

7. Subsequently, the percentage removed dirt is calculated.

All tests are checked by means of double samples and controlled by means of a reference sample. If the reference sample deviates more than 10% from the average values, the test is repeated.

The commercially applied foam cleaners used for comparison purposes contain next to polyacrylates for hardness stabilising:

| | Sample A | Sample B |
|---|---|---|
| Chlorine bleach | 20% | 17% |
| Alkali hydroxide | 5% | 8% |
| Sodium tripoly-phosphate | | 4% |
| Alkyl amine oxide | 3% | 3% |

The cleaning results which can be achieved with these are not as good as the dirt removal obtained with the present system:

| % removed dirt | grease / flour soiling | chicken liver | milk soiling |
|---|---|---|---|
| Sample A (5%) | 34.7 | 42.6 | 65.6 |
| Sample B (5%) | 24.6 | 37.7 | 58.5 |
| Present formula (5%)-30% hydrogen peroxide solution (1%) | 73.0 | 41.5 | 75.5 |

Microbiological activity

The foam system described possesses, apart from a cleaning activity, also a microbiological activity, which is unexpectedly enhanced as compared with the individual components. The microbiological behaviour was tested by means of a modified European suspension test based on two test germs which frequently occur in the food industry, staphylococcus aureus and pseudomonas aeruginosa, and compared with a 30% hydrogen peroxide solution at pH 8 (see K. H. Wallhauser, 'Praxis der Sterilisation-Desinfektion-Konservierung', 4th ed., Georg Thieme Verlag, Stuttgart, 1988) and also compared with a commercially available alkaline foam cleaner. The latter contains, besides hardness stabilisers, about 11% alkali hydroxide and 3% alkyl amine carboxylate.

| Log reduction | Concentration (%) | Treatment time (min) | *Staphylococcus aureus* | *Pseudomonas aeruginosa* |
|---|---|---|---|---|
| $H_2O_2$, pH 8 | 1 | 60 | 2 | 4 |
| Sample C | 5 | 5 | <2 | >6 |
| present formula + 30% hydrogen peroxide solution | 5 + 1 | 15 | >6 | >6 |

An example of the realisation of the injection device for carrying out the process according to the invention is explained in further detail, with reference to the drawings, following hereafter.

DETAILED DESCRIPTION OF THE EMBODIMENT

Figure 1:
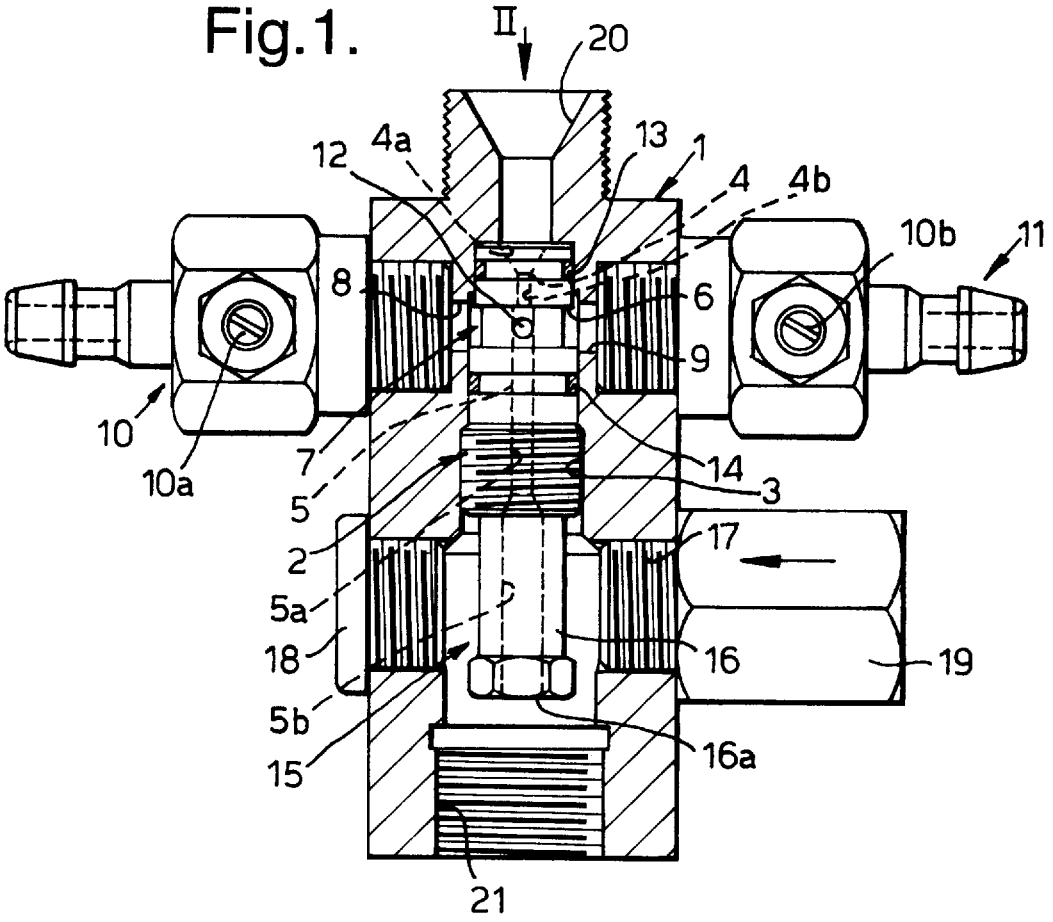
FIG. 1 shows a sectional representation of a preferred execution of the injection device and FIG. 2 shows a front view of the injection device in the direction as pointed by the arrow II in FIG. 1.
Figure 2:
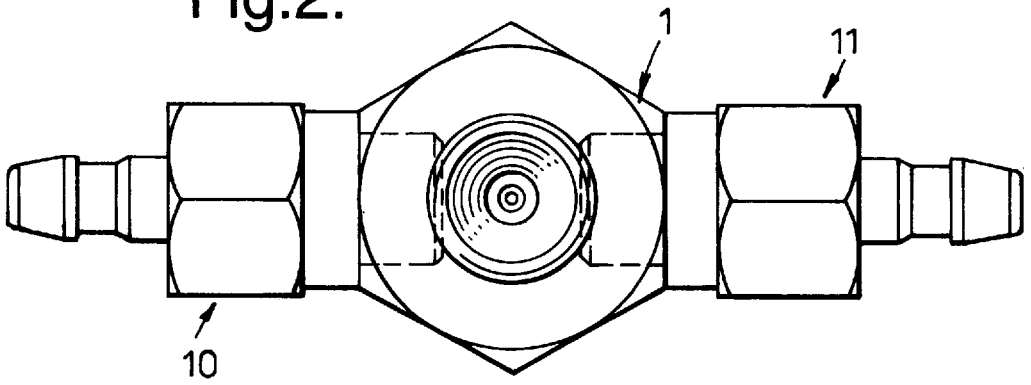

The injection device shows a hexagonally shaped metal housing body 1, for accepting a jet assembly 2, which is screwed into an axial body boring 3. The jet assembly 2 includes a jet duct 4 which is shaped as a propulsion jet with a cone shaped section 4*a* and a cylindrical section 4*b*. A flow channel 5 designed as collecting jet is connected onto the propulsion jet 4, which flow channel shows a first cylindrical section 5*a* in the direction of flow, which passes into a second cylindrical section 5*b* of which the flow cross-section is larger than that of the first section. In doing so, the first section 5*a* of the flow channel 5 which is designed as a collection jet shows a larger flow cross-section than the cylindrical channel 4*b* of the propulsion jet 4.

In the direction of flow, immediately after propulsion jet 4, the jet assembly 2 shows a circular groove 6, so as to form a circular space 7 in housing body 1 in which two inlet bores

8, 9 terminate, which bores run transversally with respect to the axial boring in the housing. For connecting the tubes, which are not shown in the figures, two connections 10, 11 are provided, which are bolted to the injector body 1 and each of which are showing a butterfly valve with adjusting screw 10*a*, 10*b* and a return valve. The circular space 7, in which the inlet bores 8, 9 terminate, is placed, via a transverse passage boring 12, immediately behind propulsion jet 4 in the direction of flow, and is connected to the flow duct of collection jet 5 and is laterally sealed against body 1 by means of two sealing rings 13, 14 which are fitted into two circular grooves of the jet assembly.

The rear section of the axial body boring in the direction of flow shows a larger cross-section than the middle section. This section forms a cylindrical turbulence chamber 15, in which the cylindrical body 16 of jet assembly 2 extends. Above the outlet orifice 16*a* of jet assembly 2, the injector body 1 shows a boring 17 which runs transversely and which is blocked on one side by a stopper 18. A connector 19 for a compressed air feed hose is screw fitted into boring 17 on the other side of the housing body.

An inlet channel 20 with a cone shaped and a cylindrical section is provided in the housing body in the direction of flow ahead of the injection assembly 2, which passes into the cylindrical section of the flow channel 4 of the propulsion jet.

The injection device operates as follows. Water under high pressure is fed through inlet 20 to the injector. Because of the reduction of the flow cross-section in propulsion jet 4, the flow speed of the transport medium is increased. The water leaving propulsion jet 4 sucks the foam cleaning agent which is fed through inlet boring 8 into the circular space 7 and the hydrogen peroxide solution which is fed via the inlet boring 9 through the transverse boring 12 into jet assembly 2, so that the fluids are mixed and are flowing from the jet assembly into the turbulence chamber 15, where the foam forming starts through the feeding of compressed via the compressed air connection 19. The dosing of both solutions may be performed thereby separately by means of the adjustment screws 10*a*, 11*a*. The cleaning foam is drained away by means of a tube which is not shown in the figures and which is connected to outlet 21 of the injector. Because the compressed air which is fed above the outlet orifice of the jet assembly into the circular space of the turbulence chamber 15, which is formed by the walls of axial boring 2 and the jet body 16, is directed sideways by the jet body, the flow of air has the same flow direction as the flow of fluid. Therefore foaming is improved and the use of chemicals is reduced.

I claim:

1. A device for cleaning surfaces which are soiled in the food industry with grease, starch or protein residues comprising:

a) a housing body having a first inlet for feeding pressurized water;

b) a propulsion jet positioned behind the inlet and in a direction of flow;

c) a collection jet positioned behind the propulsion jet which is flow connected with a second inlet for feeding a chlorine-free alkaline foam cleaning agent and a third inlet for feeding a hydrogen peroxide solution; and d) a turbulence chamber into which an elongated jet body of the collection jet extends, the turbulence chamber fitted with a chamber inlet for feeding compressed air into the chamber such that a hydrogen peroxide foam is formed from a solution formed upon dosing an effective amount of the hydrogen peroxide solution into the chlorine-free alkaline foam cleaner at a maximum of 60 seconds prior to contact of the hydrogen peroxide foam with a surface to be cleaned, the turbulence chamber further having a chamber outlet through which the hydrogen peroxide foam leaves the chamber to contact the surface, the chamber inlet and the chamber outlet being fitted in a direction of flow ahead of an outlet orifice of the jet body.

2. The device according to claim 1 wherein the turbulence chamber has a circular shape.

3. The device according to claim 1 wherein the jet body has a circular shape.

4. The device according to claim 1 wherein the hydrogen peroxide solution is dosed into the chlorine-free alkaline foam cleaning agent at a maximum of 10 seconds prior to the contact of the hydrogen peroxide foam with the surface to be cleaned.

5. The device according to claim 4 wherein the hydrogen peroxide solution is dosed into the alkaline foam cleaner within a period of time in the range of 0.01 to 1 second prior to the contact of the hydrogen peroxide foam with the surface to be cleaned.

6. The device according to claim 1 wherein the hydrogen peroxide solution is continuously dosed in a quantity to form a hydrogen peroxide foam to clean the surface to be treated.

7. The device according to claim 1, wherein the hydrogen peroxide foam cleaner comprises:

a) 3–30 wt. % of a alkali hydroxide;

b) 1–10 wt. % of an alkyl amine oxide with the general formula I $$C_mH_{2m+1}NO(C_nH_{2n+1})_x(C_nH_{2n+1})_y \quad (I)$$

in which:

m=an integer from 8–18, n=1 or 2 x=0, 1 or 2 y=0, 1 or 2, and x+y=2;

c) 2–10 wt. % of a builder material, and d) water, the foam cleaner being diluted to an application concentration of 0.1–5 wt. % alkali hydroxide.

8. The device according to claim 7 wherein a 30% hydrogen peroxide solution is used to form the application concentration having 0.1 to 1% hydrogen peroxide.

* * * * *